US012358696B2

(12) United States Patent
Li et al.

(10) Patent No.: US 12,358,696 B2
(45) Date of Patent: Jul. 15, 2025

(54) CONTAINER SEALING PLUG AND CONTAINER HAVING SAME

(71) Applicants: Huacheng Li, Lianjiang (CN); Jiejia Xie, Guangzhou (CN)

(72) Inventors: Huacheng Li, Lianjiang (CN); Jiejia Xie, Guangzhou (CN)

( * ) Notice: Subject to any disclaimer, the term of this patent is extended or adjusted under 35 U.S.C. 154(b) by 0 days.

(21) Appl. No.: 18/363,744

(22) Filed: Aug. 2, 2023

(65) Prior Publication Data

US 2023/0373693 A1 Nov. 23, 2023

(30) Foreign Application Priority Data

Apr. 13, 2023 (CN) ..... 202330199795.3
Jul. 17, 2023 (CN) ..... 202321884253.0

(51) Int. Cl.
*B65D 47/12* (2006.01)
*B65D 39/00* (2006.01)
*B65D 55/16* (2006.01)

(52) U.S. Cl.
CPC ..... *B65D 47/127* (2013.01); *B65D 39/0005* (2013.01); *B65D 55/16* (2013.01); *B65D 2539/003* (2013.01); *B65D 2547/06* (2013.01)

(58) Field of Classification Search
CPC .. B65D 47/127; B65D 39/0005; B65D 55/16; B65D 2539/003; B65D 2547/06
USPC ..... 220/375; 215/306
See application file for complete search history.

(56) References Cited

U.S. PATENT DOCUMENTS 4,132,225 A * 1/1979 Whattam ..... A61B 5/153 600/580
5,513,768 A * 5/1996 Smith ..... B65D 55/16 D9/446
5,674,209 A * 10/1997 Yarger ..... A61M 39/20 604/905
D406,238 S * 3/1999 Voller ..... D23/233
5,944,228 A * 8/1999 Gray ..... B65D 47/06 222/546
6,478,180 B1 * 11/2002 Dehn, Sr. ..... B65D 51/18 215/276
7,954,515 B2 * 6/2011 Gerst ..... F16L 55/115 138/89.1

(Continued)

FOREIGN PATENT DOCUMENTS

DE 2551162 A * 5/1976 ..... A61J 1/10
GB 2085853 A * 5/1982 ..... B65D 47/141

*Primary Examiner* — Anthony D Stashick
*Assistant Examiner* — Niki M Eloshway
(74) *Attorney, Agent, or Firm* — Hemisphere Law, PLLC; Zhigang Ma

(57) ABSTRACT

The present disclosure provides a container sealing plug, which includes a plug body and a first flexible member connected. The plug body configured to seal a receiving opening of a container body. The first flexible member connected to the plug body and having a first sleeving opening formed thereon, the first sleeving opening being configured to connect to the container body. A user can place food, liquid or other objects into the container body through the receiving opening of the container body, and then seal the receiving opening of the container body with the plug body, whereby air or water is effectively prevented from entering or leaking out the container body through the receiving opening of the container body and thus the long-term storage and freshness preservation of the content is guaranteed.

12 Claims, 5 Drawing Sheets

(56) References Cited

U.S. PATENT DOCUMENTS

| | | | | |
|---|---|---|---|---|
| 8,205,764 | B2 * | 6/2012 | Chang | B01L 3/50825 220/259.2 |
| D679,589 | S * | 4/2013 | Hauth | D9/446 |
| D872,575 | S * | 1/2020 | Tebbs | D9/446 |
| D948,929 | S * | 4/2022 | Zhang | D7/392.1 |
| 11,690,994 | B1 * | 7/2023 | Banik | A61M 39/20 604/103 |
| D993,768 | S * | 8/2023 | Xie | D9/446 |
| 2012/0091136 | A1 | 4/2012 | Gingras | |
| 2013/0020316 | A1 | 1/2013 | Hong | |
| 2014/0238988 | A1 | 8/2014 | Antal et al. | |
| 2014/0263453 | A1 * | 9/2014 | Haley | C12H 1/16 222/152 |
| 2017/0172703 | A1 * | 6/2017 | Arguello | A61C 17/08 |
| 2019/0210859 | A1 * | 7/2019 | Lambrecht | B67D 1/0004 |

* cited by examiner

CONTAINER SEALING PLUG AND CONTAINER HAVING SAME

CROSS-REFERENCE TO RELATED APPLICATIONS

The application claims priority of Chinese patent application CN202321884253.0, filed on Jul. 17, 2023, which is incorporated herein by reference in its entireties.

TECHNICAL FIELD

The present disclosure relates to the field of containers, more particularly to a container sealing plug and a container having the same.

BACKGROUND

Sealed container is a kind of container used for storing and preserving food, liquid or other objects, which can effectively prevent the entrance or leakage of air or water. Such kind of container generally has a reliable sealing mechanism for guaranteeing the long-term storage and freshness preservation of the content. The sealed container generally is made of durable materials, such as plastic, glass or metal. Different types of sealed containers are suitable for different purposes and requirements. Current sealed containers available on the market generally have a sealing structure. However, the sealing structures currently available on the market mostly are not integrally formed with the containers, easy to slip and lose, only with a single sealing function. Therefore, there is a strong need to provide a container sealing plug which is uneasy to slip or lose and has a plenty of functions, and a container having the same.

SUMMARY

In order to overcome the shortcomings of the prior art, the present disclosure provides a container sealing plug.

The container sealing plug includes a plug body configured to seal a receiving opening of a container body; and a first flexible member connected to the plug body and having a first sleeving opening formed thereon, the first sleeving opening being configured to connect to the container body.

As the improvement of the present disclosure, the first flexible member further has a hanging space formed thereon.

As the improvement of the present disclosure, the first flexible member includes a first end and a second end; the first end is connected to the plug body; and the first sleeving opening and the hanging space are arranged sequentially in a direction from the first end of the first flexible member toward the second end.

As the improvement of the present disclosure, the plug body includes a sealing part configured to seal the receiving opening of the container body.

As the improvement of the present disclosure, the plug body includes a first upper side and a first lower side and further includes a first stop part; the first stop part is arranged between the first upper side and the first lower side; and the sealing part is arranged between the first lower side and the stop part.

As the improvement of the present disclosure, the sealing part is a sealing ring.

As the improvement of the present disclosure, the first lower side is formed with a first opening, the first upper side is formed with a second opening, and the first opening is intercommunicated with the second opening; when the first lower side of the plug body is inserted into the receiving opening of the container body, the first opening is inserted into the container body along with the plug body, and the first upper side is exposed out of the container body, whereby the second opening on the first upper side is exposed out of the container body.

As the improvement of the present disclosure, a leak-proof part is provided at the second opening and the leak-proof part includes a plurality of flexible leak-proof baffles and slits; the flexible leak-proof baffles squeeze one another to cover the slits; when the flexible leak-proof baffles are acted upon by an external force that is greater than a squeezing force generated by the flexible leak-proof baffles squeezing one another, the flexible leak-proof baffles uncover the slits.

As the improvement of the present disclosure, the container sealing plug further including a cover body and a second flexible member, wherein the cover body is connected to the plug body through the second flexible member, and the cover body detachably covers the second opening.

As the improvement of the present disclosure, the first end of the first flexible member is connected to one side of the first stop part.

As the improvement of the present disclosure, the cover body is connected to the other side of the first stop part of the plug body through the second flexible member.

As the improvement of the present disclosure, the first flexible member is a first flexible belt made of silicone.

As the improvement of the present disclosure, the second flexible member is a second flexible belt made of silicone.

As the improvement of the present disclosure, the first flexible belt, the second flexible belt and the cover are integrally formed.

As the improvement of the present disclosure, a second stop part is further arranged between the first upper side and the first stop part, and the cover body includes a third stop part. When the cover body covers the second opening, the third stop part abuts on the second stop part.

As the improvement of the present disclosure, the second stop part is a stop ring. The third stop part is a stop ring groove arranged on an inner wall of the cover body.

As the improvement of the present disclosure, the plug body is a silicone plug body.

As the improvement of the present disclosure, the first upper side of the plug body has a smaller semi-diameter than the first lower side of the plug body.

As the improvement of the present disclosure, the hanging opening is configured for a user's finger to hang on.

As the improvement of the present disclosure, the number of the sealing ring is three. The three sealing rings are evenly arranged between the first lower side and the first stop part.

The present disclosure also provides a container, including a container body and a container sealing plug, The container sealing plug includes a plug body configured to seal a receiving opening of a container body; and a first flexible member connected to the plug body and having a first sleeving opening formed thereon, the first sleeving opening being configured to connect to the container body.

As the improvement of the present disclosure, the first flexible member further has a hanging space formed thereon.

As the improvement of the present disclosure, the first flexible member includes a first end and a second end; the first end is connected to the plug body; and the first sleeving opening and the hanging space are arranged sequentially in a direction from the first end of the first flexible member toward the second end.

As the improvement of the present disclosure, the plug body includes a sealing part configured to seal the receiving opening of the container body.

As the improvement of the present disclosure, the plug body includes a first upper side and a first lower side and further includes a first stop part; the first stop part is arranged between the first upper side and the first lower side; and the sealing part is arranged between the first lower side and the stop part.

As the improvement of the present disclosure, the sealing part is a sealing ring.

As the improvement of the present disclosure, the first lower side is formed with a first opening, the first upper side is formed with a second opening, and the first opening is intercommunicated with the second opening; when the first lower side of the plug body is inserted into the receiving opening of the container body, the first opening is inserted into the container body along with the plug body, and the first upper side is exposed out of the container body, whereby the second opening on the first upper side is exposed out of the container body.

As the improvement of the present disclosure, a leak-proof part is provided at the second opening and the leak-proof part includes a plurality of flexible leak-proof baffles and slits; the flexible leak-proof baffles squeeze one another to cover the slits; when the flexible leak-proof baffles are acted upon by an external force that is greater than a squeezing force generated by the flexible leak-proof baffles squeezing one another, the flexible leak-proof baffles uncover the slits.

As the improvement of the present disclosure, the container sealing plug further including a cover body and a second flexible member, wherein the cover body is connected to the plug body through the second flexible member, and the cover body detachably covers the second opening.

As the improvement of the present disclosure, the first end of the first flexible member is connected to one side of the first stop part.

As the improvement of the present disclosure, the cover body is connected to the other side of the first stop part of the plug body through the second flexible member.

As the improvement of the present disclosure, the first flexible member is a first flexible belt made of silicone.

As the improvement of the present disclosure, the second flexible member is a second flexible belt made of silicone.

As the improvement of the present disclosure, the first flexible belt, the second flexible belt and the cover are integrally formed.

As the improvement of the present disclosure, a second stop part is further arranged between the first upper side and the first stop part, and the cover body includes a third stop part. When the cover body covers the second opening, the third stop part abuts on the second stop part.

As the improvement of the present disclosure, the second stop part is a stop ring. The third stop part is a stop ring groove arranged on an inner wall of the cover body.

As the improvement of the present disclosure, the plug body is a silicone plug body.

As the improvement of the present disclosure, the first upper side of the plug body has a smaller semi-diameter than the first lower side of the plug body.

As the improvement of the present disclosure, the hanging opening is configured for a user's finger to hang on.

As the improvement of the present disclosure, the number of the sealing ring is three. The three sealing rings are evenly arranged between the first lower side and the first stop part.

Beneficial effects: the present disclosure provides a container sealing plug, which includes a plug body and a first flexible member connected. The plug body configured to seal a receiving opening of a container body. The first flexible member connected to the plug body and having a first sleeving opening formed thereon, the first sleeving opening being configured to connect to the container body. A user can place food, liquid or other objects into the container body through the receiving opening of the container body, and then seal the receiving opening of the container body with the plug body, whereby air or water is effectively prevented from entering or leaking out the container body through the receiving opening of the container body and thus the long-term storage and freshness preservation of the content is guaranteed. Due to the arrangement of the first flexible member connected to the plug body, the first sleeving opening on the first flexible member can be sleeved on the container body, for example, on a side wall of an opening of the container body, so that the plug body is connected to the container body through the first flexible member, which effectively prevents the slipping and loss of the plug body.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
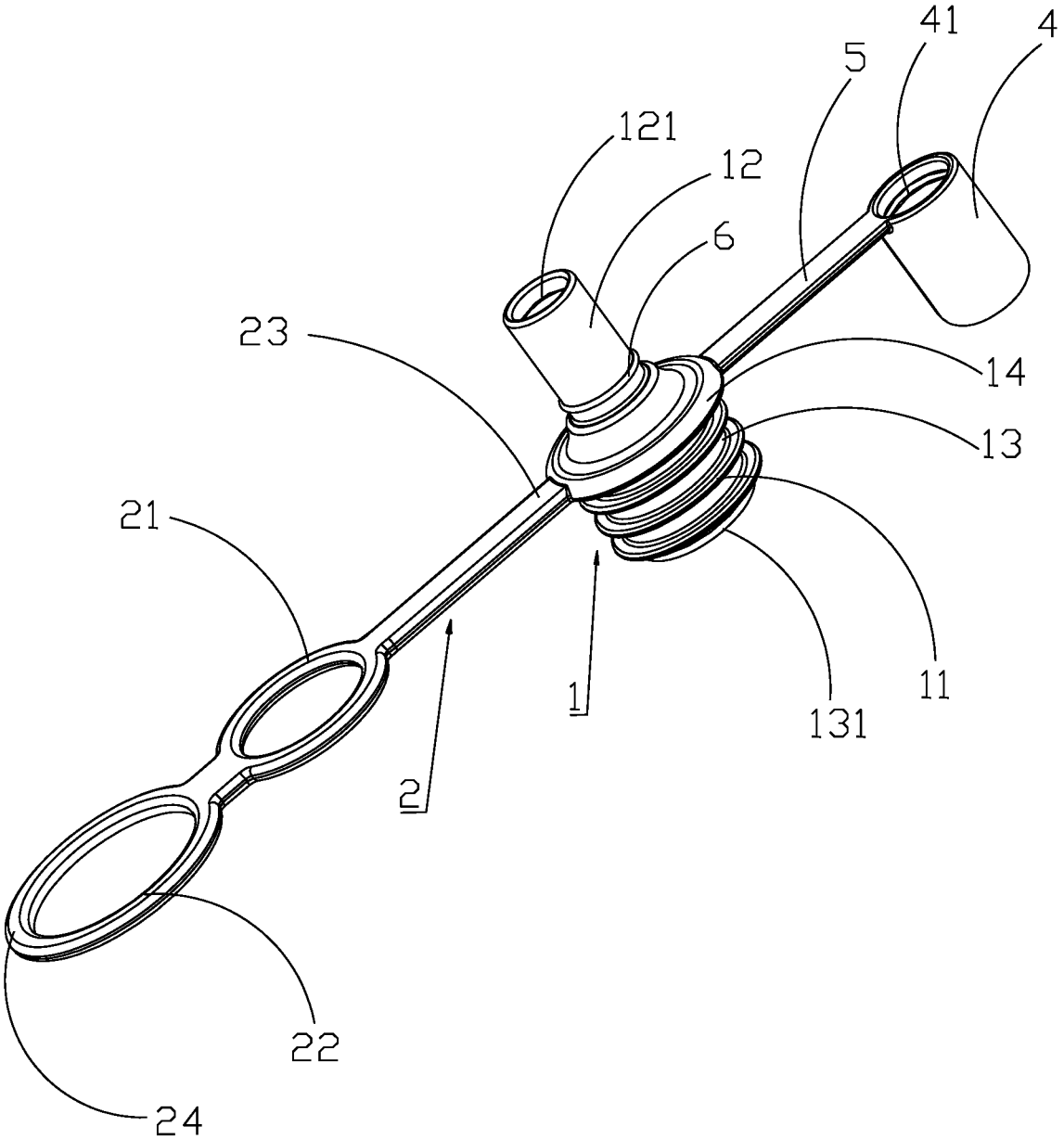
FIG. 1 is an overall structure diagram of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
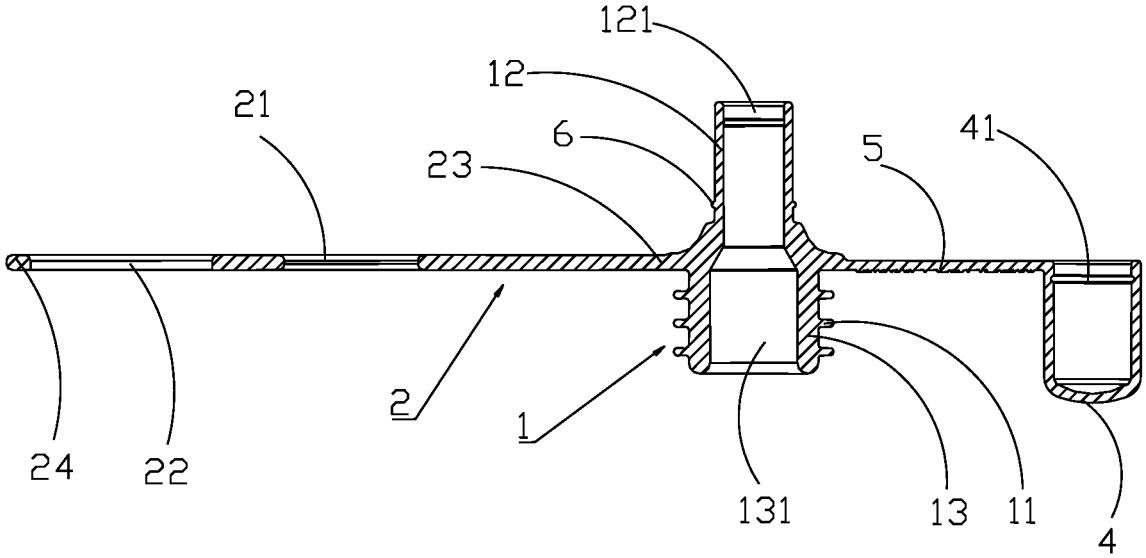
FIG. 2 is a sectional view along a plug body, a first flexible member, a second flexible member and a cover body.
Figure 3:
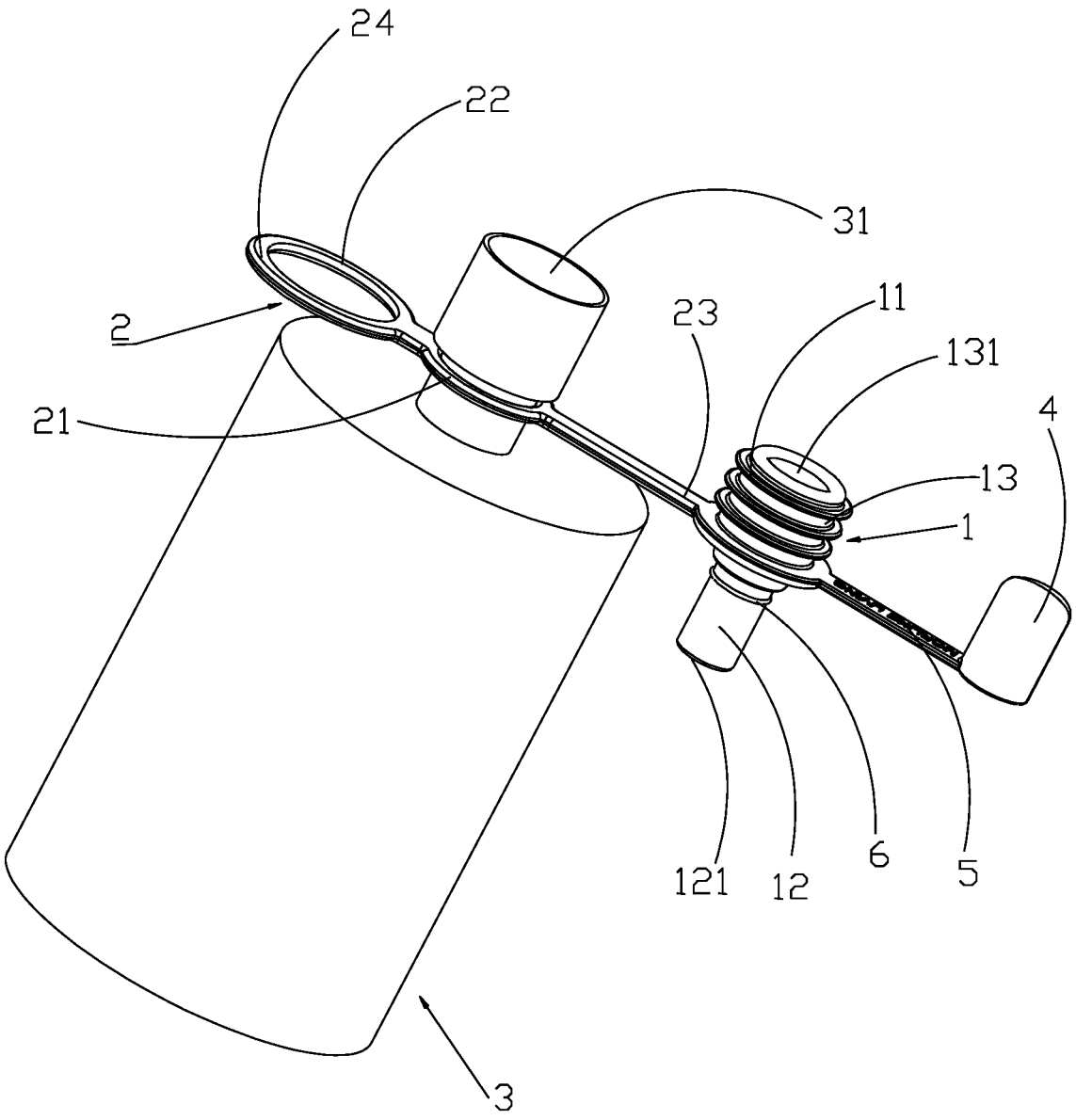
FIG. 3 is another overall structure diagram of the present disclosure.
Figure 4:
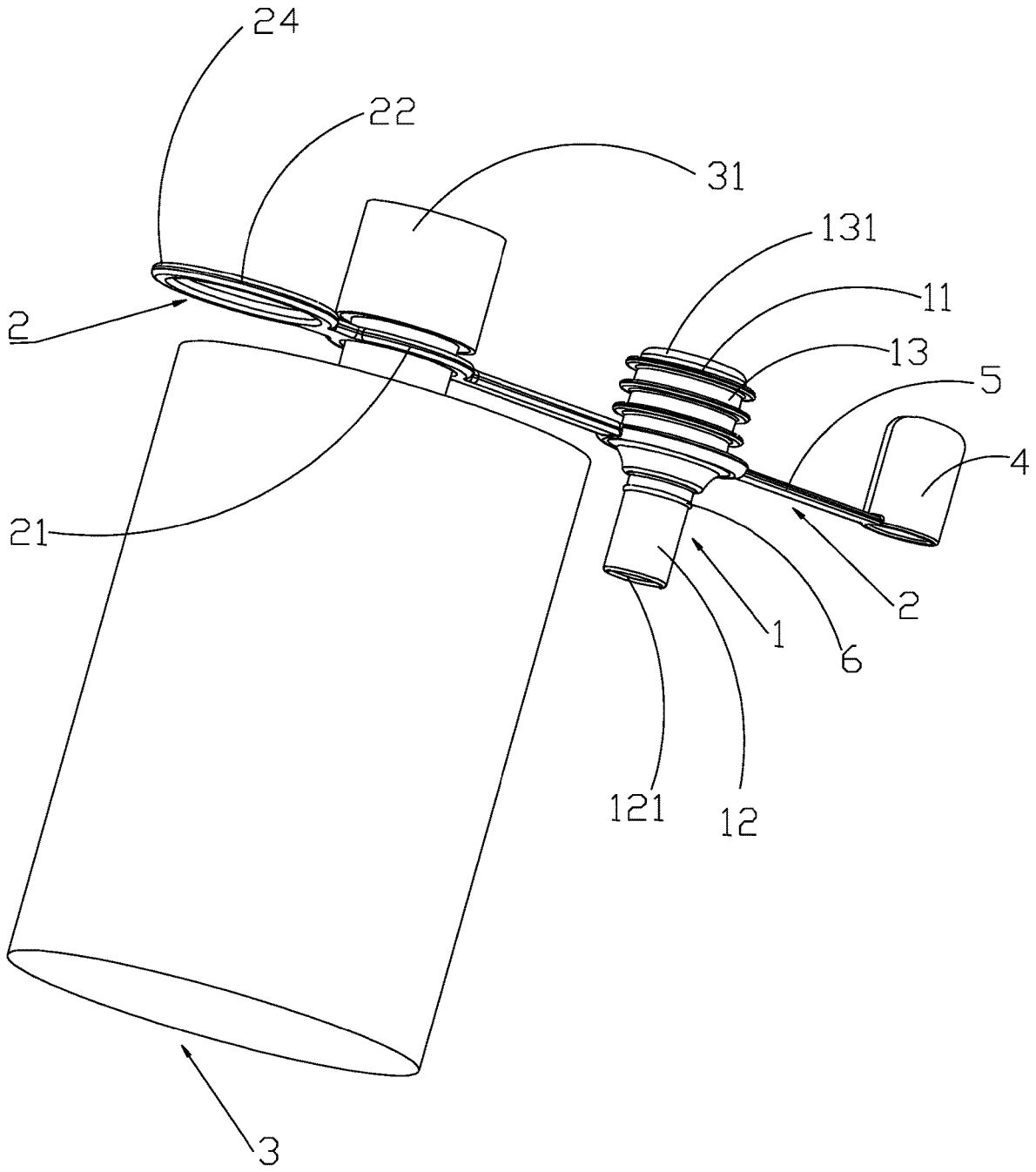
FIG. 4 is still another overall structure diagram of the present disclosure.
Figure 5:
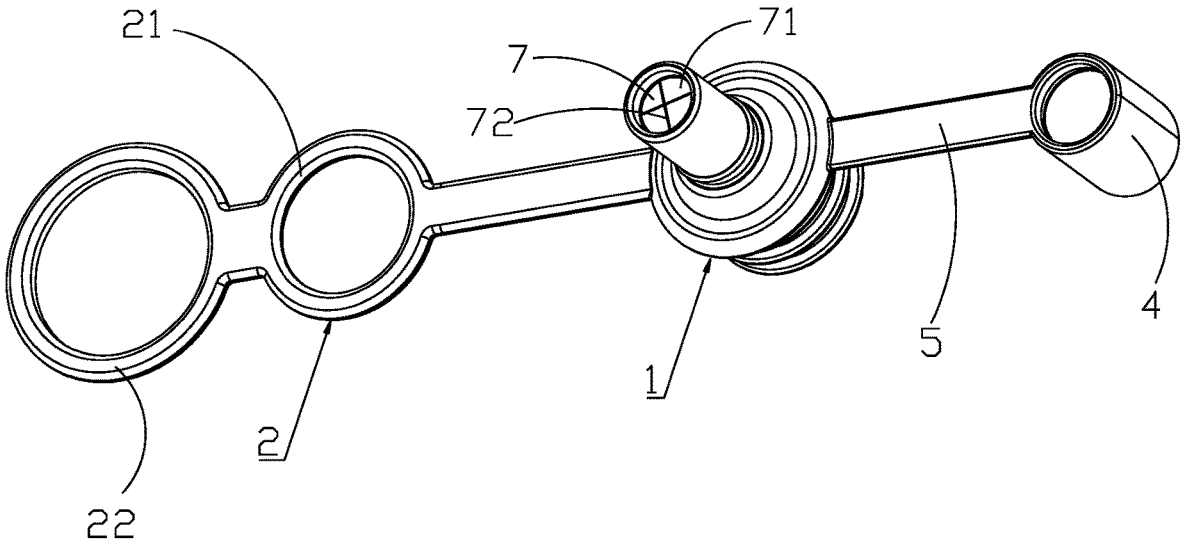
FIG. 5 is a structure diagram of a leak-proof part of the present disclosure.

Referring to FIG. 1 to FIG. 5, a container sealing plug includes: a plug body 1 configured to seal a receiving opening 31 of a container body 3; and a first flexible member 2 connected to the plug body 1 and having a first sleeving opening 21 formed thereon, the first sleeving opening 21 being configured to connect to the container body 3.

By means of the above structure, a user can place food, liquid or other objects into the container body 3 through the receiving opening 31 of the container body 3, and then seal the receiving opening 31 of the container body 3 with the plug body 1, whereby air or water is effectively prevented from entering or leaking out the container body 3 through the receiving opening 31 of the container body 3 and thus the long-term storage and freshness preservation of the content is guaranteed. Due to the arrangement of the first flexible member 2 connected to the plug body 1, the first sleeving opening 21 on the first flexible member 2 can be sleeved on the container body 3, for example, on a side wall of an opening of the container body 3, so that the plug body 1 is connected to the container body 3 through the first flexible member 2, which effectively prevents the slipping and loss of the plug body 1. Herein, the container can be a water bottle, also can be other types of containers.

Herein, the first flexible member 2 has a hanging space 22 formed thereon. Specifically, the hanging space 22 is a hanging opening. Further, the hanging opening is configured for a user's finger to hang on. Still further, the first flexible member 2 includes a first end 23 and a second end 24. The first end 23 is connected to the plug body 1. The first sleeving opening 21 and the hanging space 22 are arranged sequentially in a direction from the first end 23 of the first flexible member 2 toward the second end 24. By means of the above structure, the sealing plug achieves a reasonable design, a compact structure, and a stable connection. When the plug body 1 is sleeved on the container body 3 by means of the first sleeving opening 21 of the first flexible member 2, a user can extend a finger into the hanging opening to lift up the sealing plug and the container body 3, which is convenient for the user to carry the container body 3. In addition, when the container body 3 is not in use, the container body 3 and the plug body 1 can be hung on a wall or other external objects by means of the hanging opening, which is convenient for a user to store the container body 3 and the plug body 1.

In the present embodiment, the plug body 1 includes a sealing part 11 configured to seal the receiving opening 31 of the container body 3. Herein, the plug body 1 includes a first upper side 12 and a first lower side 13 and further includes a first stop part 14. The first stop part 14 is arranged between the first upper side 12 and the first lower side 13; and the sealing part 11 is arranged between the first lower side 13 and the stop part 14. Specifically, the sealing part 11 is a sealing ring. Further, the number of the sealing ring is three. The three sealing rings are evenly arranged between the first lower side and the first stop part. Still further, the plug body 1 is a silicone plug body 1. By means of the above structure, the sealing rings of the silicone plug body 1 can be inserted into the receiving opening 31 of the container body 3 to seal the receiving opening 31 of the container body 3. The silicone plug body 1 not only has a good sealing property, but also is difficult to age and is easy to clean. In addition, due to the arrangement of the first stop part 14, the plug body 1 can be effectively prevented from being excessively inserted into the container body 3 through the receiving opening 31 of the container body 3, with the occurrence avoided that the plug body 1 is difficult to be pulled out from the opening of the container body 3.

In the present embodiment, the first lower side 13 is formed with a first opening 131, the first upper side 12 is formed with a second opening 121, and the first opening 131 is intercommunicated with the second opening 121. When the first lower side 13 of the plug body 1 is inserted into the receiving opening 31 of the container body 3, the first opening 121 is inserted into the container body 3 along with the plug body 1, and the first upper side 12 is exposed out of the container body 3, whereby the second opening 121 on the first upper side 12 is exposed out of the container body 3. Herein, a cover body 4 and a second flexible member 5 are further included, wherein the cover body 4 is connected to the plug body 1 through the second flexible member 5, and the cover body 4 detachably covers the second opening 121. By means of the above structure, when a user needs to pour out a liquid inside the container body 3, he/she can remove the cover body 4 from the second opening 121, so that the liquid can flow out through the first opening 131 and the second opening 121.

In the present embodiment, a leak-proof part 7 is provided at the second opening 121 and the leak-proof part 7 includes a plurality of flexible leak-proof baffles 71 and slits 72. The flexible leak-proof baffles 71 squeeze one another to cover the slits 72. When the flexible leak-proof baffles 71 are acted upon by an external force that is greater than a squeezing force generated by the flexible leak-proof baffles 71 squeezing one another, the flexible leak-proof baffles 71 uncover the slits 72. By means of the above structure, when the leak-proof baffles are not acted upon by an external force, the flexible leak-proof baffles 71 squeeze one another to cover the slits 72, whereby preventing a liquid flowing out through the first opening 131, the second opening 121 and the slits 72. When a user needs to pour out a liquid inside the container body 3 to drink, a liquid impact force arising from the pouring out of the liquid inside the container can impact on the flexible leak-proof baffles 71, whereby canceling the coverage of the flexible leak-proof baffles 71 on the slits 72, so that the liquid can flow out through the first opening 131, the second opening 121 and the slits 72. Herein, the number of the flexible leak-proof baffles are four. The four flexible leak-proof baffles are evenly disposed around an inside of the second opening. A cross shape is formed between the plurality of slits.

In the present embodiment, the first end 23 of the first flexible member 2 is connected to one side of the first stop part 14. Herein, the cover body 4 is connected to the other side of the first stop part 14 of the plug body 1 through the second flexible member 5. Specifically, the first flexible member 2 is a first flexible belt made of silicone. Further, the second flexible member 5 is a second flexible belt made of silicone. By means of the above structure, not only are the first flexible member 2 and the second flexible member 5 effectively achieved, but the connection between the cover body 4 and the plug body 1 and the connection between the plug body 1 and the container body 3 are achieved. Specifically, the first flexible belt, the second flexible belt and the cover are integrally formed.

In the present embodiment, a second stop part 6 is further arranged between the first upper side 12 and the first stop part 14, and the cover body 4 includes a third stop part 41. When the cover body 4 covers the second opening 121, the third stop part 41 abuts on the second stop part 6. Herein, the first upper side 12 of the plug body 1 has a smaller semi-diameter than the first lower side 13 of the plug body 1. The second stop part 6 is a stop ring. The third stop part 41 is a stop ring groove arranged on an inner wall of the cover body 4. By means of the above structure, the cover body 4 is easy to accurately cover the second opening 121, preventing the occurrence of excessive covering to result in crack of the cover body 4.

A container body 3 including the above container sealing plug. By means of the above structure, a user can place food, liquid or other objects into the container body 3 through the receiving opening 31 of the container body 3, and then seal the receiving opening 31 of the container body 3 with the plug body 1, whereby air or water is effectively prevented from entering or leaking out the container body 3 through the receiving opening 31 of the container body 3 and thus the long-term storage and freshness preservation of the content is guaranteed. Due to the arrangement of the first flexible member 2 connected to the plug body 1, the first sleeving opening 21 on the first flexible member 2 can be sleeved on the container body 3, for example, on a side wall of an opening of the container body 3, so that the plug body 1 is connected to the container body 3 through the first flexible member 2, which effectively prevents the slipping and loss of the plug body 1. Herein, the container can be a water bottle, also can be other types of containers.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A container sealing plug, comprising:

a plug body configured to seal a receiving opening of a container body; and a first flexible member connected removably to the plug body and having a first sleeving opening formed thereon, the first sleeving opening being configured to sleeve on the container body;

wherein the first flexible member further has a hanging opening formed thereon;

wherein the first flexible member comprises a first end and a second end; the first end is connected to the plug body; and the plug body, the first sleeving opening and the hanging opening are arranged sequentially in a direction from the first end of the first flexible member toward the second end;

wherein the plug body comprises a sealing part configured to seal the receiving opening of the container body;

wherein the plug body comprises a first upper side and a first lower side and further comprises a first stop part; the first stop part is arranged between the first upper side and the first lower side; and the sealing part is arranged between the first lower side and the stop part;

wherein the first lower side is formed with a first opening, the first upper side is formed with a second opening, and the first opening is intercommunicated with the second opening; when the first lower side of the plug body is inserted into the receiving opening of the container body, the first opening is inserted into the container body along with the plug body, and the first upper side is exposed out of the container, whereby the second opening on the first upper side is exposed out of the container.

2. The container sealing plug according to claim 1, wherein the sealing part is a sealing ring.

3. The container sealing plug according to claim 1, wherein a leak-proof part is provided at the second opening and the leak-proof part comprises a plurality of flexible leak-proof baffles and slits; the flexible leak-proof baffles squeeze one another to cover the slits; when the flexible leak-proof baffles are acted upon by an external force that is greater than a squeezing force generated by the flexible leak-proof baffles squeezing one another, the flexible leak-proof baffles uncover the slits.

4. The container sealing plug according to claim 1, further comprising a cover body and a second flexible member, wherein the cover body is connected to the plug body through the second flexible member, and the cover body detachably covers the second opening.

5. A container, comprising a container body and a container sealing plug, the container sealing plug comprising:

a plug body configured to removably seal a receiving opening of the container body; and a first flexible member connected to the plug body and having a first sleeving opening formed thereon, the first sleeving opening being configured to connect to the container body;

wherein the plug body comprises a sealing part configured to seal the receiving opening of the container body;

wherein the plug body comprises a first upper side and a first lower side and further comprises a first stop part; the first stop part is arranged between the first upper side and the first lower side; and the sealing part is arranged between the first lower side and the stop part; and wherein the first lower side is formed with a first opening, the first upper side is formed with a second opening, and the first opening is intercommunicated with the second opening; when the first lower side of the plug body is inserted into the receiving opening of the container body, the first opening is inserted into the container body along with the plug body, and the first upper side is exposed out of the container, whereby the second opening on the first upper side is exposed out of the container;

wherein the first flexible member further has a hanging space formed thereon;

wherein the first flexible member comprises a first end and a second end; the first end is connected to the plug body; and the first sleeving opening and the hanging space are arranged sequentially in a direction from the first end of the first flexible member toward the second end.

6. The container according to claim 5, wherein the sealing part is a sealing ring.

7. The container according to claim 5, wherein a leak-proof part is provided at the second opening and the leak-proof part comprises a plurality of flexible leak-proof baffles and slits; the flexible leak-proof baffles squeeze one another to cover the slits; when the flexible leak-proof baffles are acted upon by an external force that is greater than a squeezing force generated by the flexible leak-proof baffles squeezing one another, the flexible leak-proof baffles uncover the slits.

8. The container according to claim 5, further comprising a cover body and a second flexible member, wherein the cover body is connected to the plug body through the second flexible member, and the cover body detachably covers the second opening.

9. A container sealing plug, comprising:

a plug body, wherein the plug body is configured to seal a receiving opening of a container; the plug body comprises a sealing part; the sealing part is configured to seal the receiving opening of the container; and the sealing part is configured to press an inner wall that seals the receiving opening of the sealed container;

wherein the plug body comprises a first upper side and a first lower side; the plug body further comprises a first stop part; the first stop part is arranged between the first upper side and the first lower side; and the sealing part is arranged between the first lower side and the first stop part;

wherein the first lower side is provided with a first opening; the first upper side is provided with a second opening; the first opening is intercommunicated with the second opening; and when the first lower side of the plug body is inserted into the receiving opening of the container, the first opening is inserted into the container along with the plug body, and the first upper side is exposed out of the container, whereby the second opening on the first upper side is exposed out of the container; wherein the first stop part is exposed out of the container;

wherein the container sealing plug further comprises a cover body and a first flexible member, wherein the cover body is connected to the plug body through the first flexible member, and the cover body is detachably covered at the second opening;

wherein a leak-proof part is arranged at the second opening, and the leak-proof part comprises a plurality of flexible leak-proof baffles and slits; the flexible leak-proof baffles are configured for pressing one another to cover the slits; and when the flexible leak-proof baffles are acted upon by an external force that is greater than a pressing force generated by the flexible leak-proof baffles pressing one another, the flexible leak-proof baffles uncover the slits;

wherein when the cover body covers the second opening, the cover body is configured for wrapping around the second opening, and an inner wall of the cover body is positioned outside of an inner wall of the second opening.

10. The container sealing plug according to claim 9, wherein a diameter of the first stop part extending in a horizontal direction is larger than a diameter of the first upper side, the diameter of the first stop part is larger than a diameter of the first lower side, and the diameter of the first stop part is larger than a diameter of the sealing ring.

11. The container sealing plug according to claim 9, wherein a hanging space and the cover body are arranged at two opposite sides of the plug body, and the hanging space, the cover body, and the plug body are arranged in a straight line.

12. The container sealing plug according to claim 9, wherein the sealing part is provided with an elastic sealing ring; and the sealing ring is configured to press an inner wall that seals the receiving opening of the sealed container.

* * * * *